US007566838B1

(12) United States Patent
Kuo

(10) Patent No.: US 7,566,838 B1
(45) Date of Patent: Jul. 28, 2009

(54) ROTARY DIP SWITCH

(75) Inventor: Yung-Ming Kuo, Dadu Township, Taichung County (TW)

(73) Assignee: Excel Cell Electronic Co., Ltd., Taichung (TW)

( * ) Notice: Subject to any disclaimer, the term of this patent is extended or adjusted under 35 U.S.C. 154(b) by 0 days.

(21) Appl. No.: 12/339,911

(22) Filed: Dec. 19, 2008

(51) Int. Cl.
*H01H 19/20* (2006.01)
*H01H 3/52* (2006.01)

(52) U.S. Cl. ..... 200/6 R; 200/6 BB; 200/11 R; 200/292; 200/336; 200/564; 200/568; 200/569; 200/573

(58) Field of Classification Search ..... 200/1 A, 200/6 R, 6 B, 6 BB, 11 R, 292, 336, 564, 200/568, 569, 573; 361/781
See application file for complete search history.

(56) References Cited

U.S. PATENT DOCUMENTS 4,260,860 A * 4/1981 Niihama et al. ..... 200/6 R
5,010,214 A * 4/1991 Yamazaki ..... 200/6 B
5,814,775 A * 9/1998 Chou ..... 200/11 R

FOREIGN PATENT DOCUMENTS

JP 11-039997 2/1999
JP 2000113773 A * 4/2000

* cited by examiner

*Primary Examiner*—Ramon M Barrera
(74) *Attorney, Agent, or Firm*—Darby & Darby P.C.

(57) ABSTRACT

A rotary DIP switch includes a base having a receiving space and a shaft, a plurality of fixed contact terminals having fixed contact portions exposed in the receiving space, and a contact plate having a plurality of movable contact portions to contact the fixed contact portions. A rotary member is disposed above the contact plate, and includes a press plate having a periphery interconnecting radial top and bottom faces thereof, and a plurality of press members to respectively press the movable contact portions against the fixed contact portions. The periphery has an axially extending first face, and an inclined second face. A top cover covers the rotary member, and includes two wing plates each having a tongue plate with an abutment portion to abut against the second face.

9 Claims, 13 Drawing Sheets

ROTARY DIP SWITCH

BACKGROUND OF THE INVENTION

1. Field of the Invention

This invention relates to a switch, more particularly to a rotary DIP (dual in-line package) switch.

2. Description of the Related Art

Referring to FIGS. 1 and 2, a conventional rotary DIP switch 10, as disclosed in Japanese Publication No. H11-39997, is shown to include a base 11, a plurality of fixed contact terminals 12 connected to the base 11 by insert molding, a contact plate 13 disposed on the base 11 and having a plurality of movable contact terminals 131, a fixed plate 14 disposed above the contact plate 13, a seal ring 15 disposed on the base 11, a rotary member 16 mounted rotatably on the base 11 and pressing against the seal ring 15, and a top cover 17 covering the rotary member 16 and engaging the base 11.

The rotary member 16 has a top face 161 formed with a cross-shaped recess 1611 for receiving a tool (not shown), a bottom face 162 provided with a plurality of press members 164 for pressing appropriate ones of the movable contact terminals 131, and a periphery 163 interconnecting the top and bottom faces 161, 162 and having a wavy-shaped pattern. The top cover 17 has a top plate 172 formed with a through hole 171 to receive and expose the top face 161 of the rotary member 16, two connecting plates 173 extending downwardly and respectively from two opposite ends of the top plate 172 and engaged to the base 11, and two abutment plates 175 extending downwardly and respectively from two other opposite ends of the top plate 172. Each abutment plate 175 has a radial projection 174 abutting against the periphery 163 of the rotary member 16.

Although the conventional rotary DIP switch 10 has the rotary member 16 with the press members 164 that are capable of pressing the desired ones of the movable contact terminals 131 to contact electrically the corresponding ones of the fixed contact terminals 12 so as to produce an output signal, the conventional switch 10 has the following drawbacks:

1. Since the top cover 17 uses the radial projections 174 of the abutment plates 175 to abut against the periphery 163 of the rotary member 16, only a horizontal radial force (Fx) is exerted on the periphery 163 of the rotary member 16. That is, no force is applied to the rotary member 16 which would ensure electrical contact between the movable contact terminals 131 and the corresponding fixed contact terminals 12, and therefore, the quality of the conventional switch 10 is adversely affected.

2. The top cover 17 presses the rotary member 16 with the horizontal radial force (Fx) which is concentrated in a single direction. Although this can permit the radial projections 174 to press stably against the periphery 163 of the rotary member 16, rotation of the rotary member 16 is made difficult.

SUMMARY OF THE INVENTION

Therefore, the object of the present invention is to provide a rotary DIP switch that is capable of overcoming the aforementioned drawbacks of the prior art.

According to this invention, a rotary DIP switch comprises a base, a plurality of fixed contact terminals, a contact plate, a rotary member, and a top cover. The base has a receiving space indented downwardly from a top face thereof, and a shaft disposed in the receiving space. The fixed contact terminals are fixed to the base, and have fixed contact portions exposed in the receiving space. The contact plate is disposed in the receiving space above the fixed contact terminals, is sleeved around the shaft, and includes a plurality of movable contact portions to contact the fixed contact portions. The rotary member is disposed in the receiving space above the contact plate, and includes a press plate having radial top and bottom faces, a central sleeve portion sleeved on the shaft and having a central hole for receiving the shaft, and a plurality of press members disposed around the central sleeve portion to respectively press the movable contact portions against the fixed contact portions. The press plate has a periphery interconnecting the radial top and bottom faces. The periphery has an axially extending first face and an inclined second face. The first face extends from one of the radial bottom and top faces and axially of the shaft. The second face extends inclinedly and inwardly from the first face to the other one of the radial bottom and top faces. The top cover covers the rotary member, and includes a top plate that has a through hole, two connecting plates extending downwardly and respectively from two opposite ends of the top plate and engaged to the base, and two wing plates extending downwardly and respectively from two other opposite ends of the top plate. Each of the wing plates has a tongue plate projecting inwardly from a respective one of the wing plates. The tongue plate has a resilient bent portion, and an abutment portion formed on the bent portion to abut against the second face.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
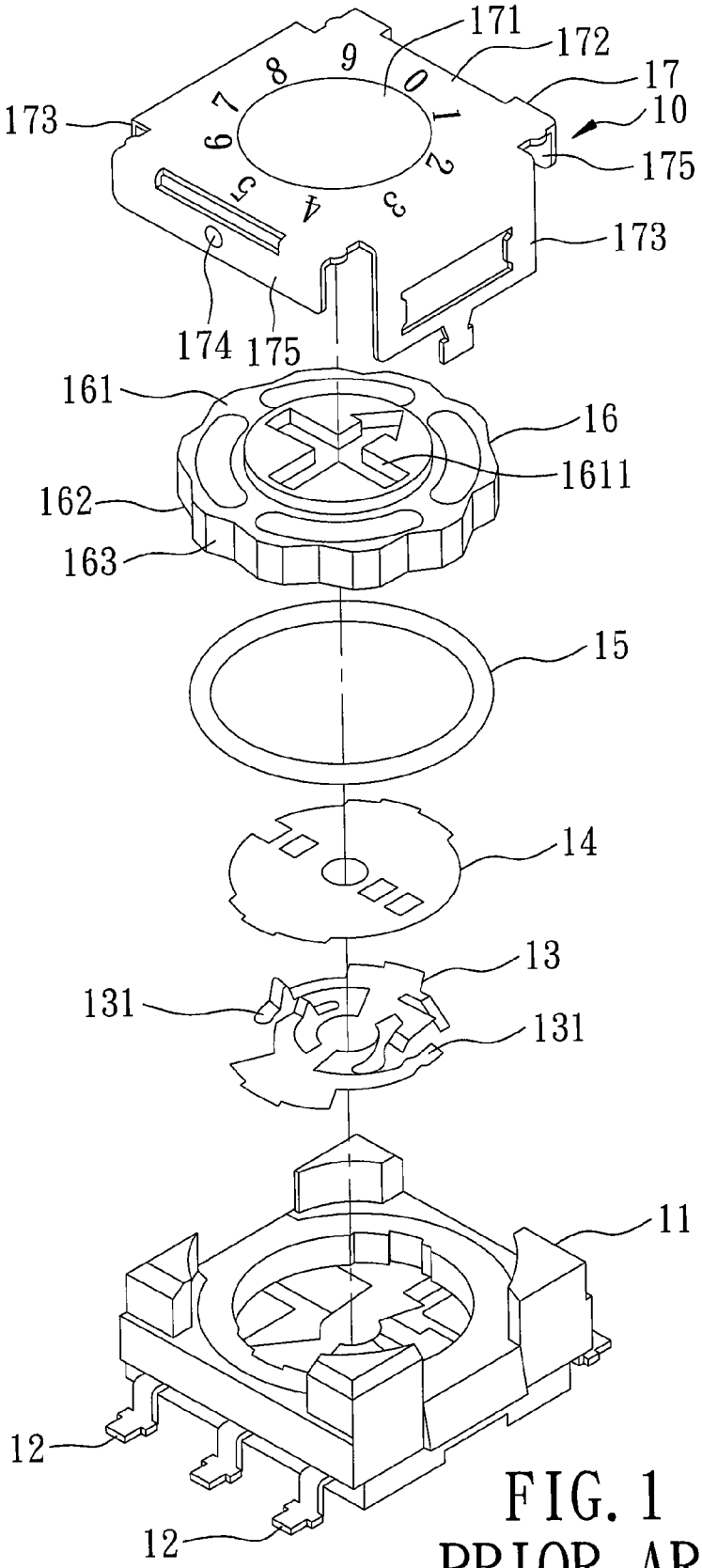
FIG. 1 PRIOR ART
FIG. 1 is an exploded perspective view of a conventional rotary DIP switch disclosed in Japanese Patent No. H11-39997.
Figure 2:
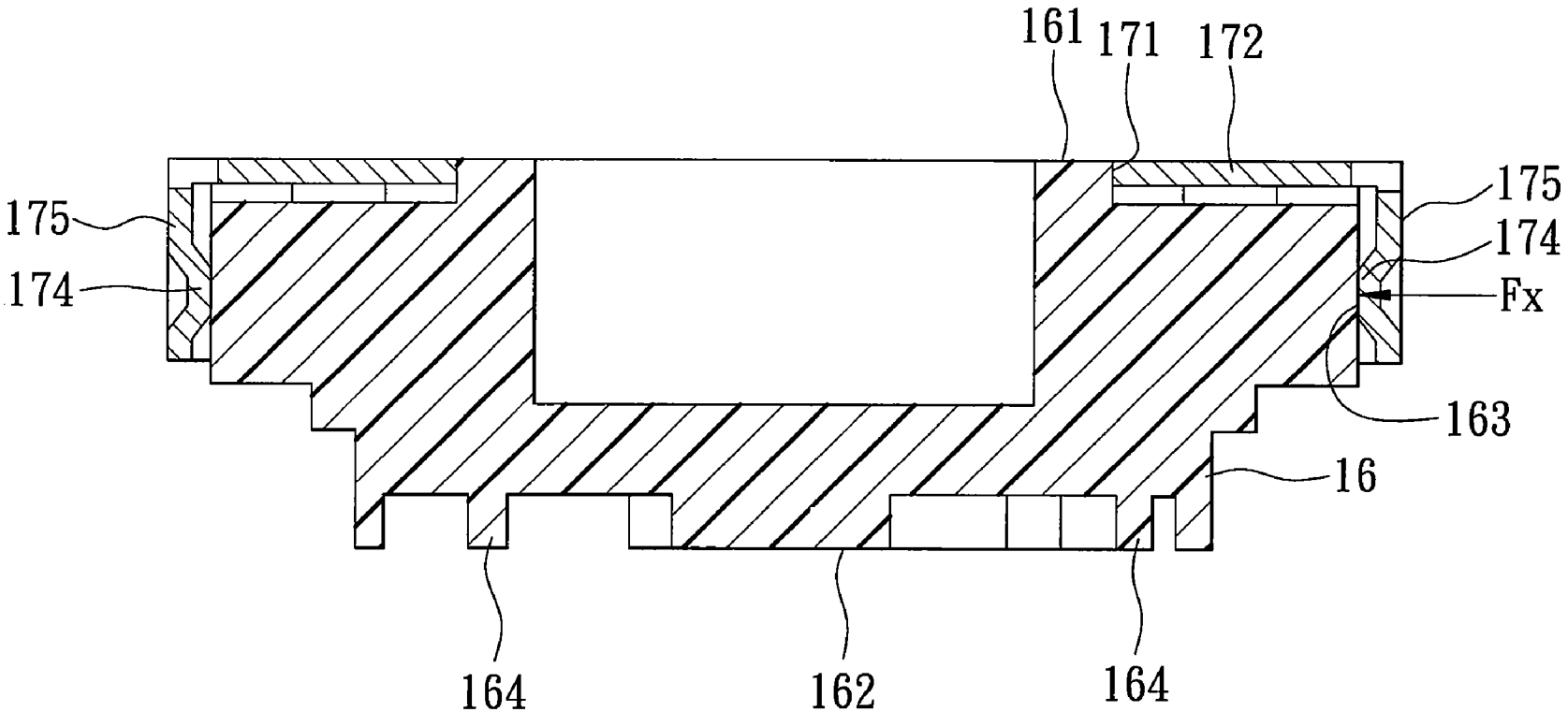
FIG. 2 PRIOR ART
FIG. 2 is a sectional view of a top cover and a rotary member of the conventional rotary DIP switch of FIG. 1 in an assembled state.
Figure 3:
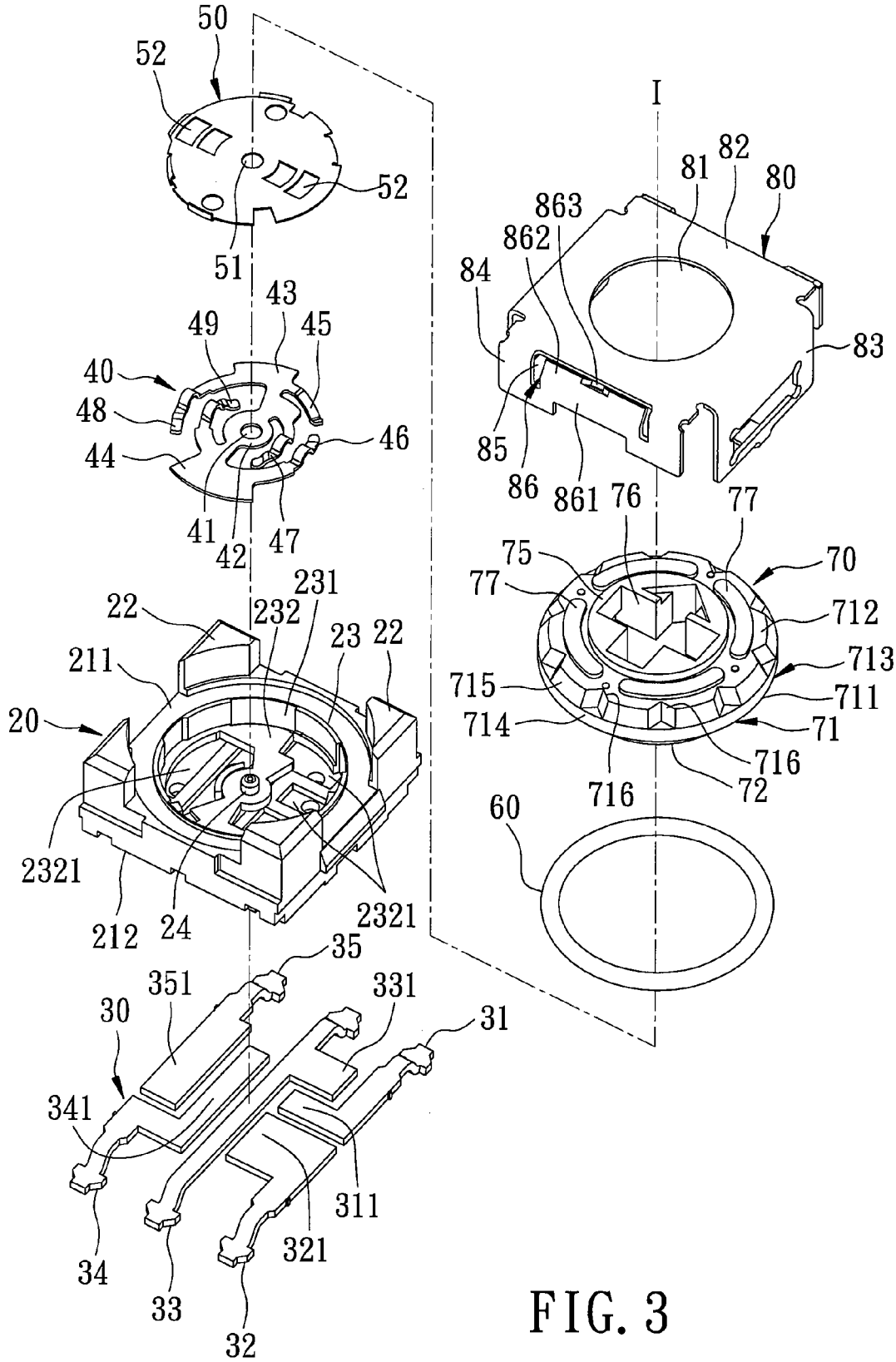
FIG. 3 is an exploded perspective view of a rotary DIP switch according to the first preferred embodiment of the present invention.
Figure 4:
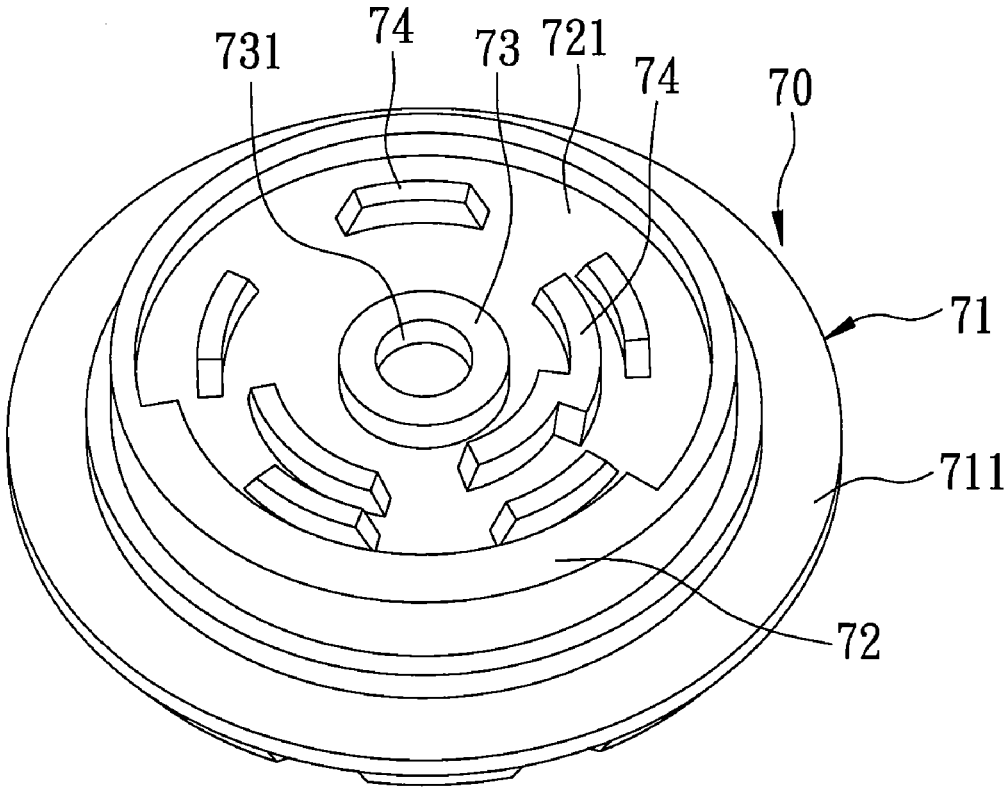
FIG. 4 is a perspective view of a bottom portion of a rotary member of the first preferred embodiment.
Figure 5:
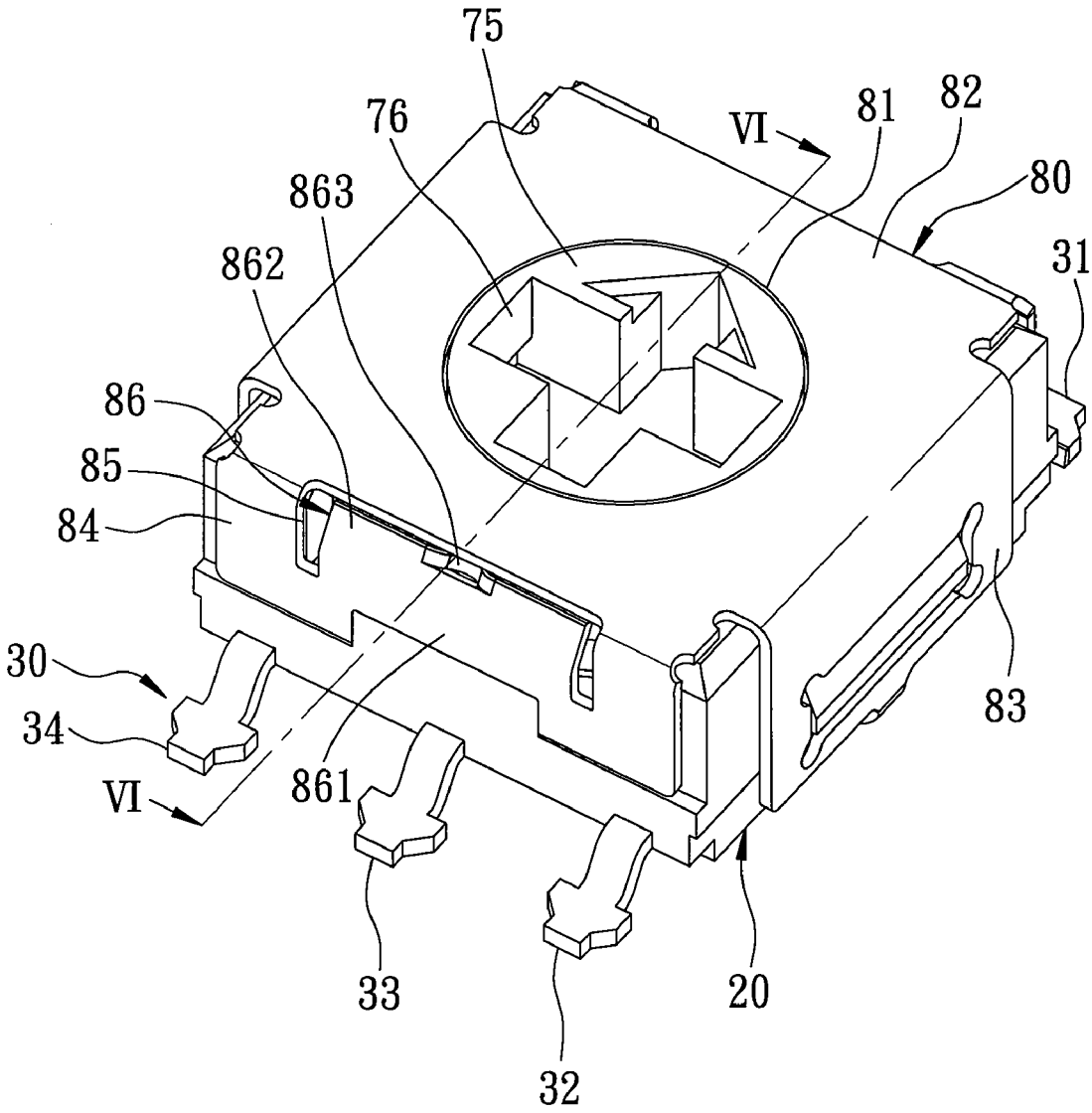
FIG. 5 is a perspective view of the first preferred embodiment in an assembled state.
Figure 6:
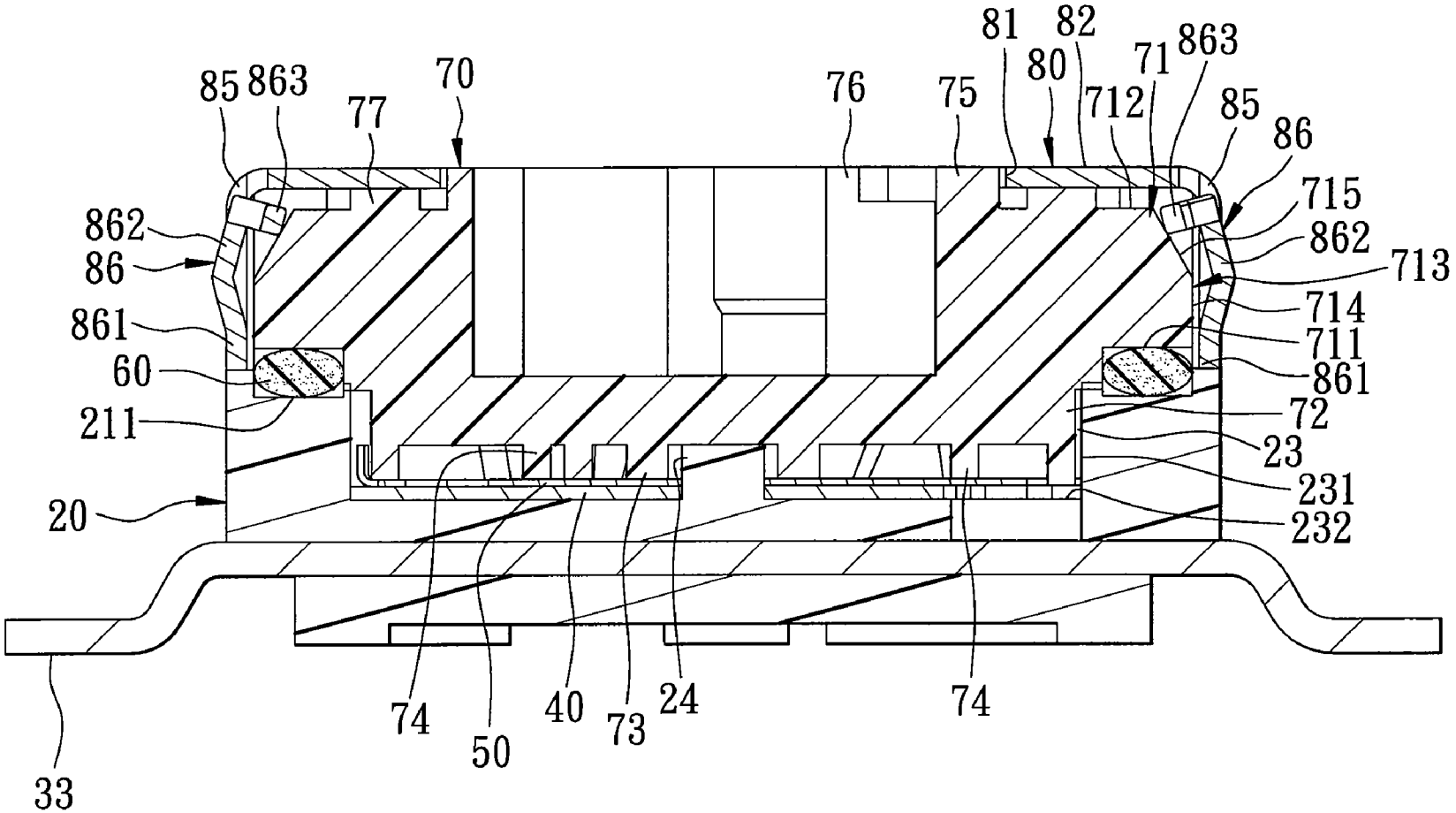
FIG. 6 is a sectional view of the first preferred embodiment taken along line VI-VI of FIG. 5.

Before the present invention is described in greater detail, it should be noted that the same reference numerals have been used to denote like elements throughout the specification.

Referring to FIGS. 3 to 9, a rotary DIP switch according to the first preferred embodiment of the present invention is shown to comprise a base 20, a fixed contact terminal unit 30, a contact plate 40, a fixed plate 50, a seal ring 60, a rotary member 70, and a top cover 80.

The base 20 has top and bottom faces 211, 212, four projections 22 projecting upwardly and respectively from four corners of the top face 211, a receiving space 23 indented downwardly from the top face 211 and defined by a peripheral wall 231 and a bottom wall 232, and a shaft 24 disposed in the receiving space 23 and projecting upwardly from the bottom wall 232. The bottom wall 232 is formed with a plurality of cutout portions 2321 in spatial communication with the receiving space 23.

The fixed contact terminal unit 30 includes first to fifth fixed contact terminals 31~35 connected to the base 20 by insert molding. The third fixed contact terminal 33 is disposed between the first and fifth fixed contact terminals 31, 35 and between the second and fourth fixed contact terminals 32, 34, so that the first and second fixed contact terminals 31, 32 are on one side of the third fixed contact terminal 33, while the fourth and fifth fixed contact terminals 34, 35 are on the other side of the third fixed contact terminal 33. The first to fifth fixed contact terminals 31~35 have fixed contact portions 311, 321, 331, 341, 351 exposed in the receiving space 23 through the cutout portions 2321.

The contact plate 40 is disposed in the receiving space 23 above the fixed contact terminals 31~35, and is sleeved around the shaft 24. The contact plate 40 includes a central portion 42 having a through hole 41 for extension of the shaft 24 therethrough, first and second connecting portions 43, 44 extending outwardly, radially, and oppositely from the central portion 42, first and second movable contact portions 45, 46 extending curvedly and respectively from the first and second connecting portions 43, 44 toward each other, a third movable contact portion 47 extending curvedly from the first connecting portion 43 between the central portion 42 and the first and second movable contact portions 45, 46, a fourth movable contact portion 48 extending curvedly from the first connecting portion 43 opposite to the first movable contact portion 45, and a fifth movable contact portion 49 extending curvedly from the second connecting portion 44 between the central portion 42 and the fourth movable contact portion 48. The second to fifth movable contact portions 46~49 respectively have bumps.

The fixed plate 50 is sleeved around the shaft 24 via a through hole 51 thereof, and is disposed above the contact plate 40 within the receiving space 23. The fixed plate 50 has four aligned slots 52 to receive the bumps of the respective second to fifth movable contact portions 46~49.

The seal ring 60 is disposed on the top face 211 between the projections 22 and the receiving space 23.

The rotary member 70 includes a circular press plate 71, a tubular insert 72 projecting downwardly from a radial bottom face 711 of the press plate 71 and inserted into the receiving space 23, a central sleeve portion 73 projecting downwardly from a bottom face 721 of the tubular insert 72 and having a central hole 731 for receiving the shaft 24, and a plurality of press members 74 projecting downwardly from the bottom face 721 and disposed around the central sleeve portion 73 to press respectively the first to fifth movable contact portions 45~49 against the fixed contact portions 311, 321, 331, 341, 351.

Figure 7:
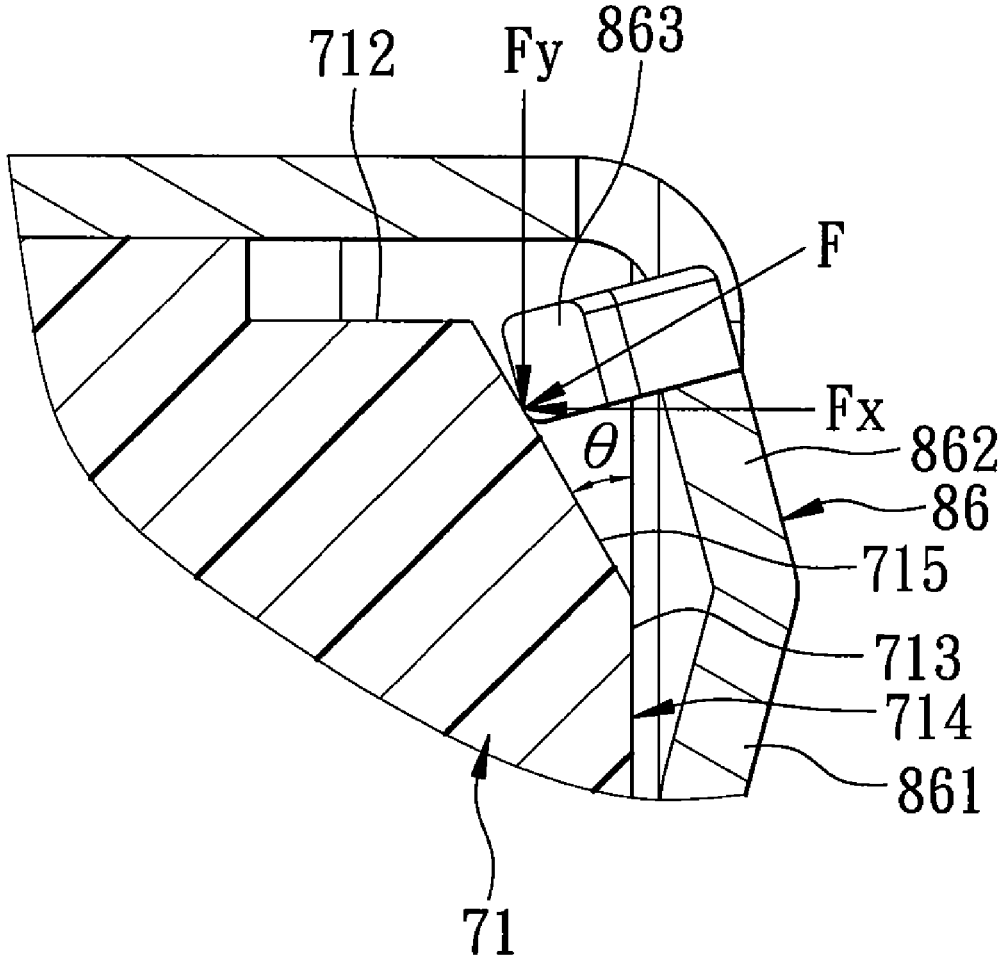
FIG. 7 is a fragmentary enlarged sectional view of the first preferred embodiment taken from FIG. 6.
Figure 8:
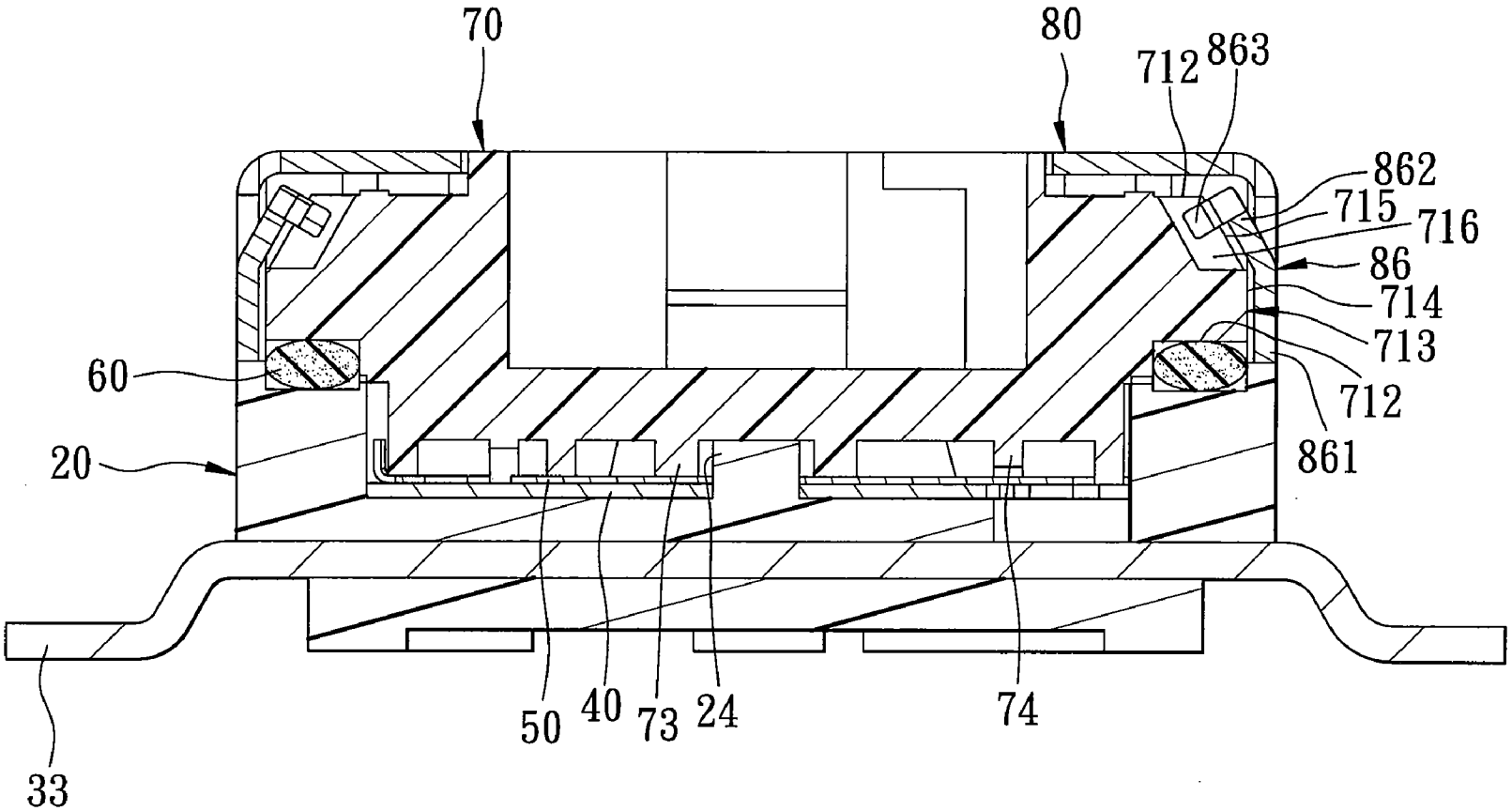
FIG. 8 is a view similar to FIG. 6, but illustrating another position of the rotary member.
Figure 9:
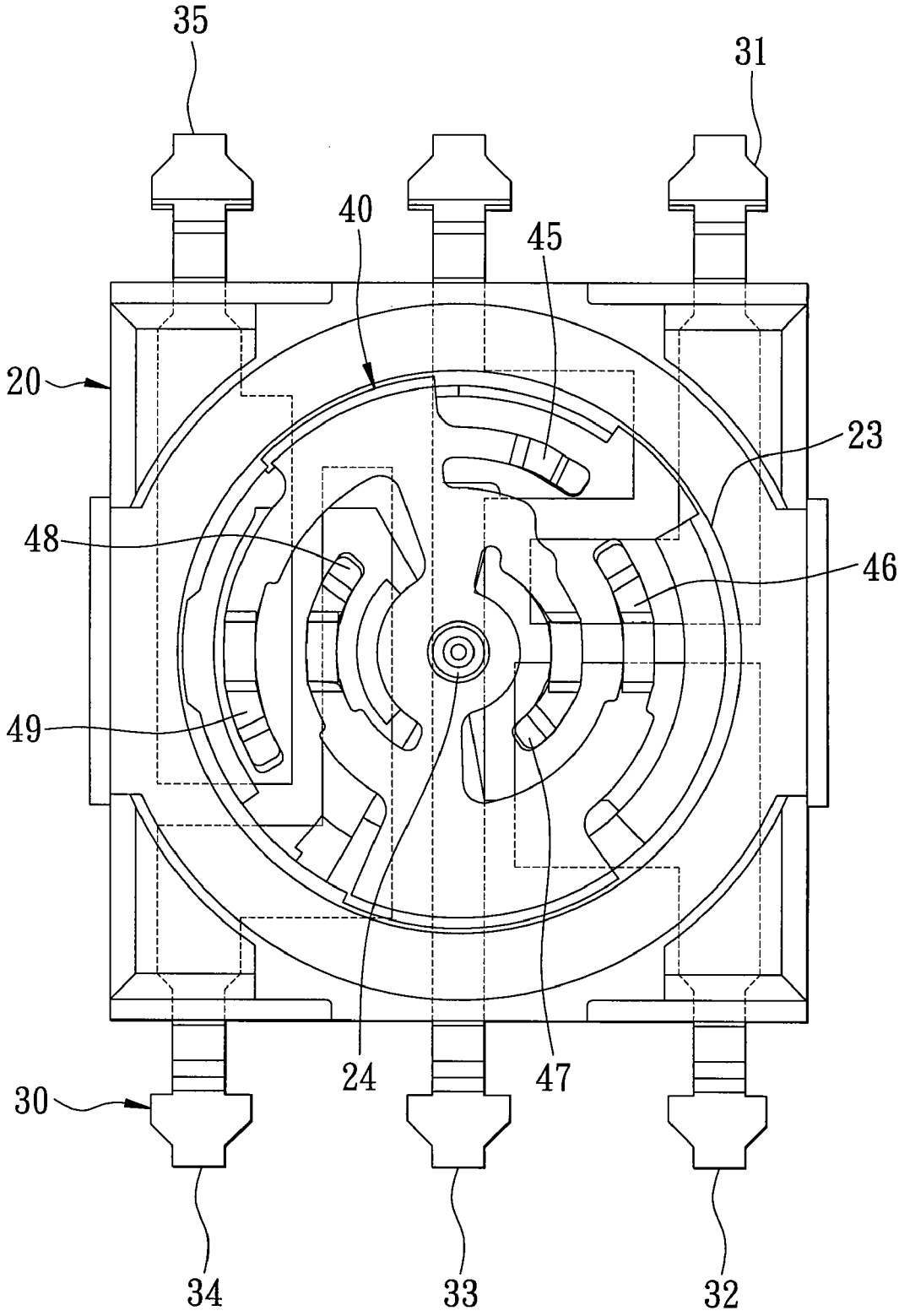
FIG. 9 is a schematic top view of the first preferred embodiment, but without the top cover, the rotary member, and a seal ring.
Figure 10:
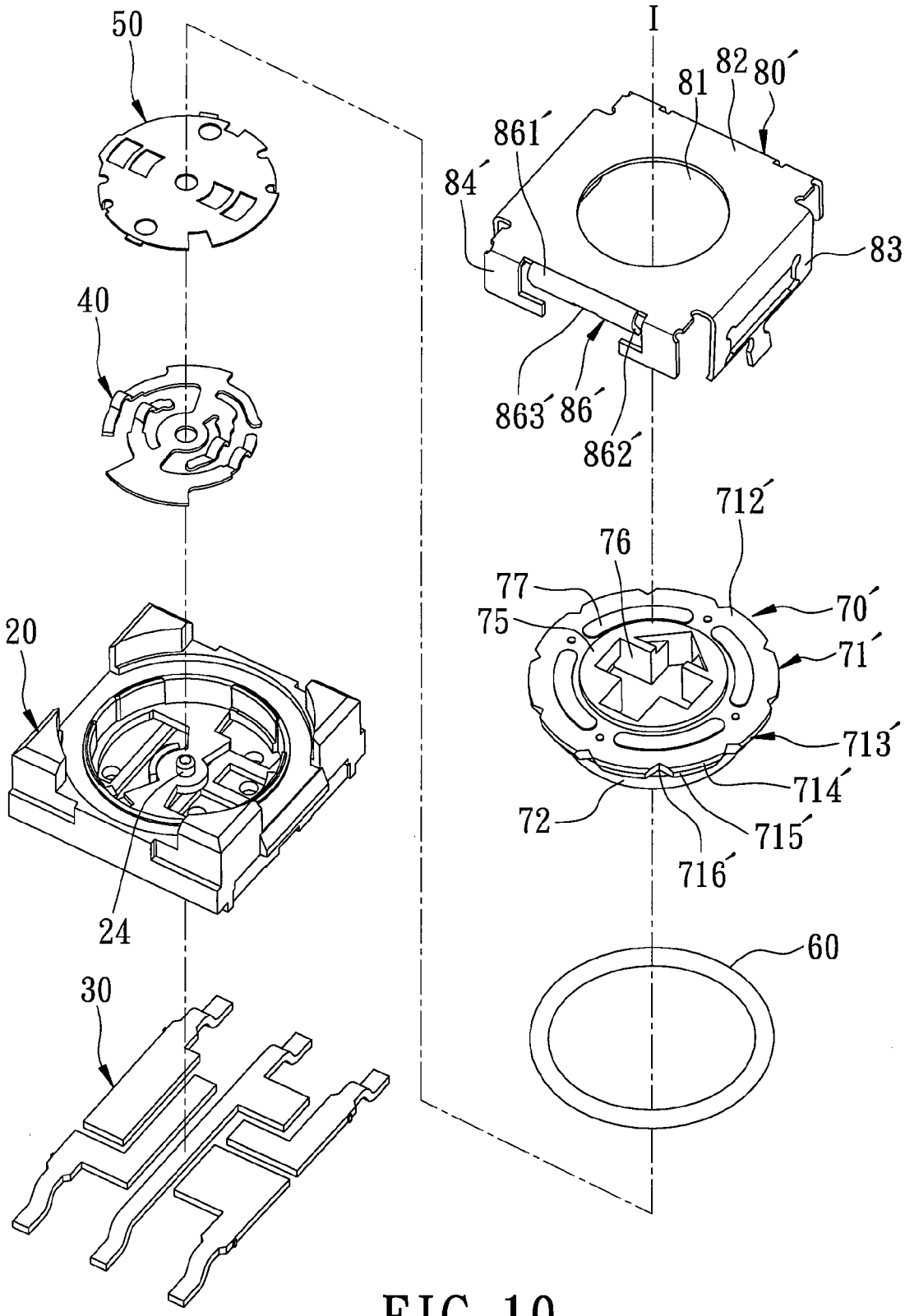
FIG. 10 is an exploded perspective view of a rotary DIP switch according to the second preferred embodiment of the present invention.
Figure 11:
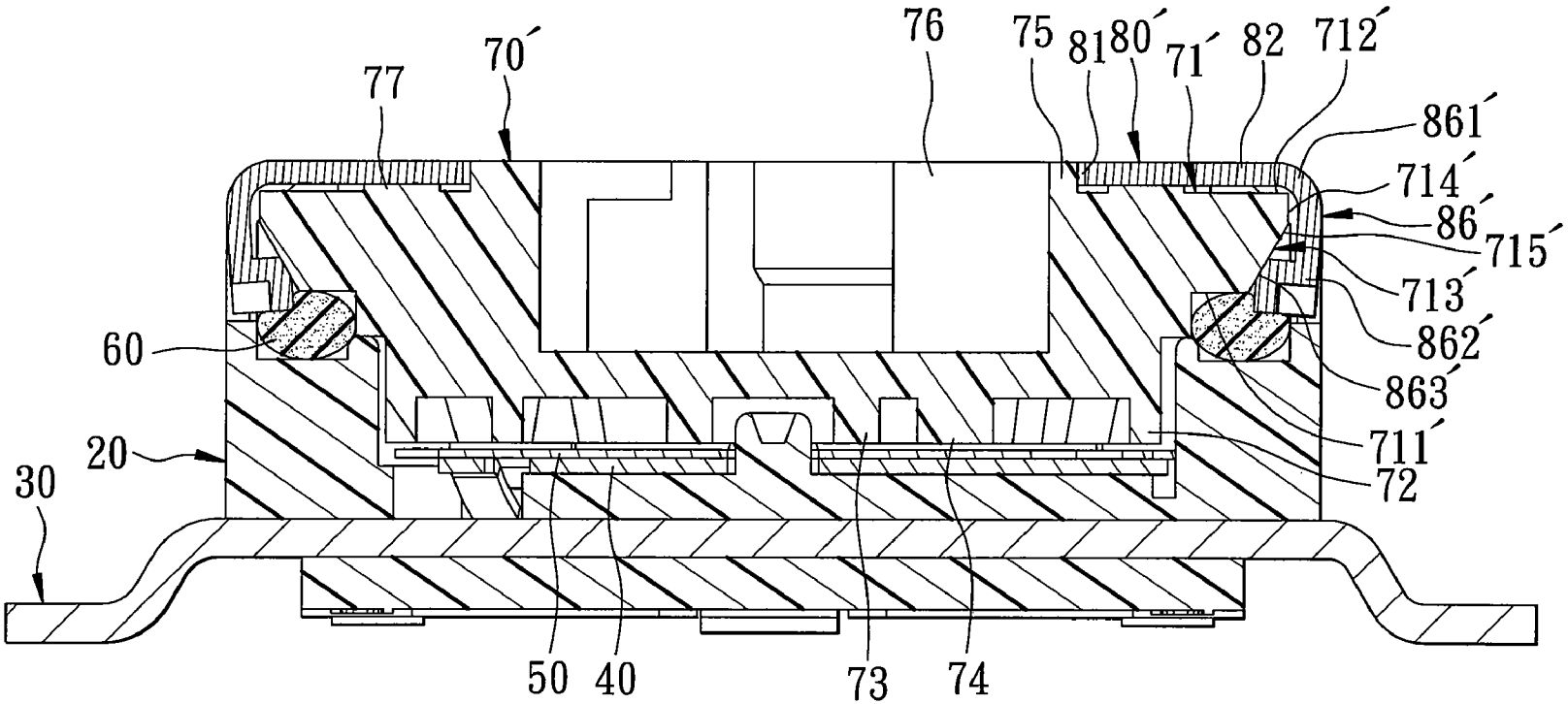
FIG. 11 is a sectional view of the second preferred embodiment in an assembled state.

The press plate 71 is disposed on the top face 211 of the base 20, and has the radial bottom face 711 pressing against the seal ring 60, a radial top face 712, and a periphery 713 interconnecting the radial top and bottom faces 712, 711. The periphery 713 has an axially extending first face 714 and an inclined second face 715. In this embodiment, the first face 714 extends upwardly from the radial bottom face 711 and axially of the shaft 24, and the second face 715 extends upwardly, inclinedly, and inwardly from the first face 713 to the radial top face 712. The second face 715 is inclined with respect to the first face 714 at an angle (θ) of 15° to 70°. Preferably, the second face 715 is inclined with respect to the first face 714 at an angle (θ) of 45°, as shown in FIG. 7. The periphery 713 of the press plate 71 further has a plurality of angularly spaced-apart grooves 716 formed in the second face 715. Each groove 716 is V-shaped.

The rotary member 70 further includes a circular projection 75 projecting upwardly from the radial top face 712, a recess 76 formed in the circular projection 75 for insertion of a driving tool (not shown) therein, and a plurality of curved bearing pieces 77 projecting upwardly from the radial top face 712 and surrounding the projection 75.

The top cover 80 is made of a thin metal plate, and includes a top plate 82 having a through hole 81, two connecting plates 83 extending downwardly and respectively from two opposite ends of the top plate 82 for engagement with the base 20, and two wing plates 84 extending downwardly and respectively from the other two opposite ends of the top plate 82. Each of the wing plates 84 has an inverted-U shaped slot 85, and a tongue plate 86 formed in the slot 85. The tongue plate 86 has a connecting portion 861 connected to the respective wing plate 84, a resilient bent portion 862 bending inwardly from the connecting portion 861, and an abutment portion 863 formed on a top end of the bent portion 862. The abutment portion 863 has a V-shaped configuration made by punching the top end of the bent portion 862, and is releasably received in a corresponding one of the V-shaped grooves 716.

With reference to FIGS. 3 to 6, to assemble the rotary DIP switch of the present invention, the contact plate 40 and the fixed plate 50 are first disposed inside the receiving space 23, followed by the seal ring 60 which is placed on the top face 211 of the base 20. Afterwards, the tubular insert 72 of the rotary member 70 is inserted into the receiving space 23 so that the bottom face 711 of the press plate 71 presses against the seal ring 60. The rotary member 70 is then covered by the top cover 80 with the circular projection 75 extending into the through hole 81 so that the recess 76 is exposed on the top cover 80. The connecting plates 83 of the top cover 80 are then engaged to the base 20 by using a tool (not shown). At this time, the top plate 82 is seated on the bearing pieces 77, and the abutment portions 863 of the tongue plates 86 of the wing plates 84 abut against the second face 715 of the rotary member 70.

With reference to FIGS. 3, 5, 6, 8, and 9, in use, by rotating the rotary member 70, the press members 74 are rotated therealong so as to press the desired ones of the first to fifth movable contact terminals 45~49 to contact electrically the corresponding ones of the first to fifth fixed contact terminals 311, 321, 331, 341, 351, thereby producing a desired output signal. It should be noted that during rotation of the rotary member 70, when the abutment portions 863 extend into the corresponding V-shaped grooves 716, because the abutment portions 863 are also V-shaped and are made of thin metal plates, the user can easily feel and detect rotation of the rotary member 70 as a result of vibrations generated through engagement of the abutment portions 863 with the V-shaped grooves 716.

Referring to FIGS. 10 to 13, a rotary DIP switch according to the second preferred embodiment of the present invention is shown to be similar to the first preferred embodiment. However, in this embodiment, the periphery 713' of the press plate 71' of the rotary member 70' has an axially extending first face 714' extending downwardly from the radial top face 712' and axially of the shaft 24, an inclined second face 715' extending downwardly, inwardly, and inclinedly from the first face 714' to the radial bottom face 711', and a plurality of angularly spaced-apart V-shaped grooves 716' formed in the first and second faces 714', 715' of the periphery 713'.

The tongue plate 86' of each wing plate 84' of the top cover 80' has a connecting portion 861' with a top end connected to the top plate 82, a resilient bent portion 862' bending inwardly from a bottom end of the connecting portion 861', and an abutment portion 863' formed on a bottom end of the bent portion 862' and made by punching.

After assembly of the components of the second preferred embodiment, through the abutment portions 863' of the tongue plates 86' that press against the second face 715' of the rotary member 70', a similar effect of use described in the first preferred embodiment may be achieved.

Figure 12:
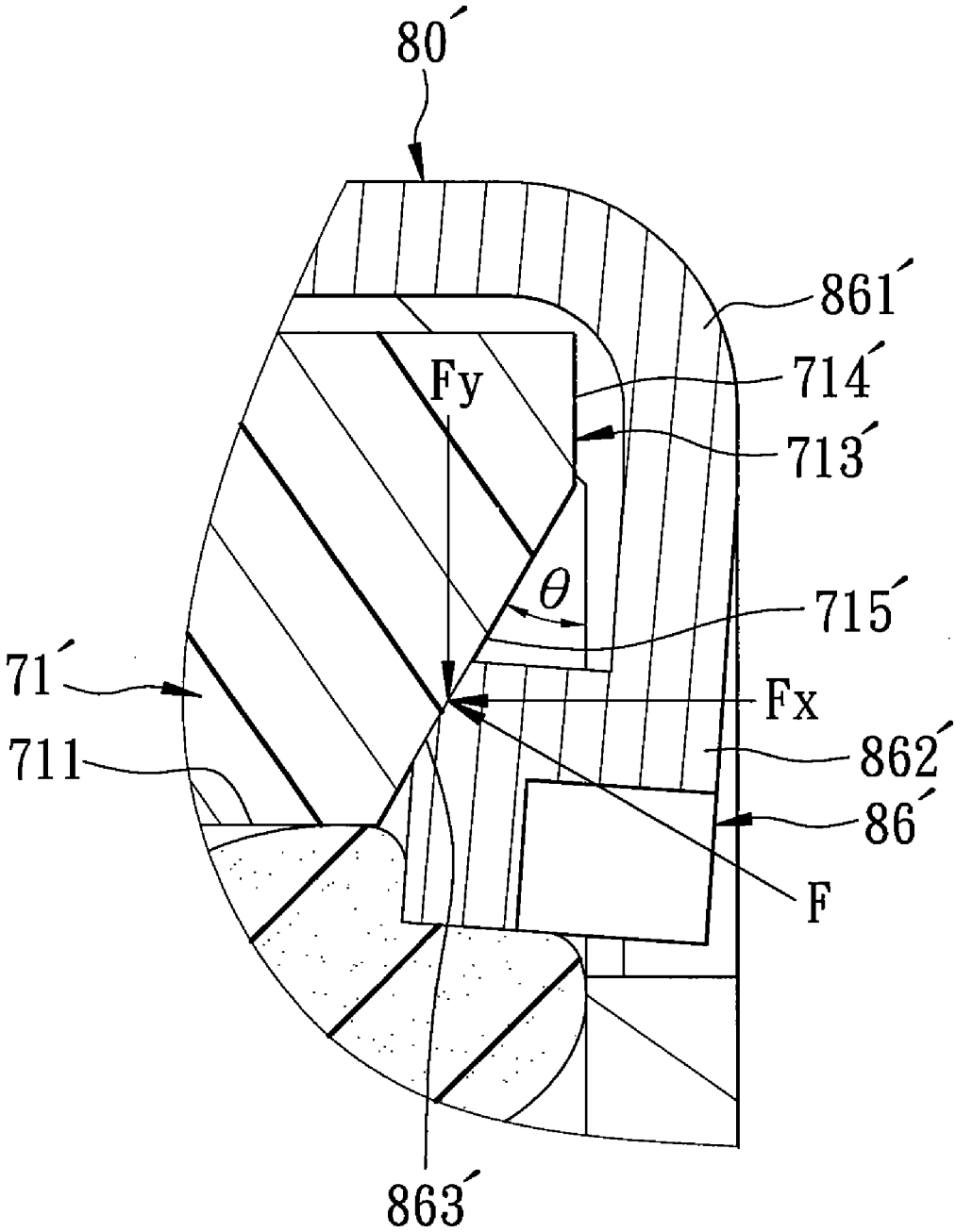
FIG. 12 is a fragmentary enlarged sectional view of the second preferred embodiment taken from FIG. 11.
Figure 13:
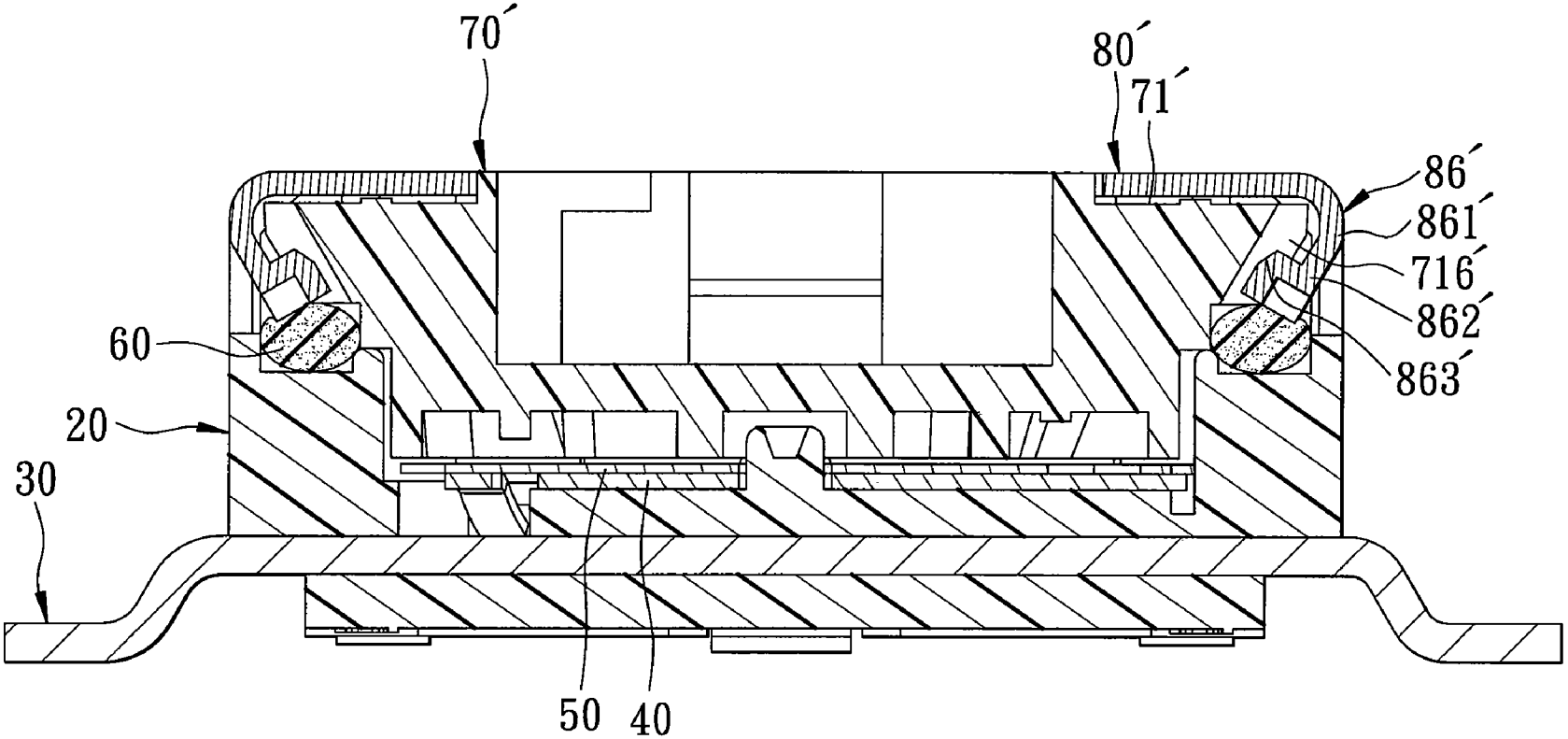
FIG. 13 is a view similar to FIG. 11, but illustrating another position of a rotary member of the second preferred embodiment.

The advantages and efficacy of the present invention can be summarized as follows:

1. Because the first face 714, 714' and the second face 715, 715' of the rotary member 70, 70' define therebetween an included angle (θ) which ranges from 15° to 70°, the abutment portion 863, 863' of the tongue plate 86, 86' of each wing plate 84, 84' that presses against the second face 715, 715' exerts a force (F) at an angle (see FIGS. 7 and 12). As a result, the force (F) has an x-component (Fx) and a y-component (Fy), as best shown in FIGS. 7 and 12. The x-component (Fx) is a horizontal force that is exerted on the rotary member 70, 70' so that the abutment portion 863, 863' can press stably against the second face 715, 715'. The y-component (Fy) is a vertical force that presses the rotary member 70, 70' downwardly so as to increase a downward pressing force against the contact plate 40. As a result, effective contact between the movable contact portions 45~49 and the corresponding fixed contact portions 331, 321, 331, 341, 351 of the fixed contact terminals 31~35 can be enhanced, which in turn, enhances the quality of the rotary DIP switch of the present invention.

2. Because the abutment force (F) exerted by the abutment portion 863, 863' of the tongue plate 86, 86' against the second face 715, 715' of the rotary member 70, 70' is applied at an angle, it has a horizontal x-component (Fx) and the vertical y-component (Fy) as described above. This is in contrast to the conventional rotary DIP switch shown in FIG. 1 in which the radial projections 174 of the abutment plates 175 exert a single horizontal abutment force (Fx) against the periphery 163 of the rotary member 16. As a result, the rotary member 70, 70' of the present invention can be rotated with ease, so that use of the present invention is easy and convenient.

While the present invention has been described in connection with what are considered the most practical and preferred embodiments, it is understood that this invention is not limited to the disclosed embodiments but is intended to cover various arrangements included within the spirit and scope of the broadest interpretations and equivalent arrangements.

I claim:

1. A rotary DIP switch comprising:

a base having a receiving space indented downwardly from a top face thereof, and a shaft disposed in said receiving space;

a plurality of fixed contact terminals fixed to said base and having fixed contact portions exposed in said receiving space;

a contact plate disposed in said receiving space above said fixed contact terminals and sleeved around said shaft, said contact plate including a plurality of movable contact portions to contact said fixed contact portions;

a rotary member disposed in said receiving space above said contact plate, and including a press plate having radial top and bottom faces, a central sleeve portion sleeved on said shaft and having a central hole for receiving said shaft, and a plurality of press members disposed around said central sleeve portion to respectively press said movable contact portions against said fixed contact portions, said press plate having a periphery interconnecting said radial top and bottom faces, said periphery having an axially extending first face and an inclined second face, said first face extending from one of said radial bottom and top faces and axially of said shaft, said second face extending inclinedly and inwardly from said first face to the other one of said radial bottom and top faces; and a top cover covering said rotary member and including a top plate that has a through hole, two connecting plates extending downwardly and respectively from two opposite ends of said top plate and engaged to said base, and two wing plates extending downwardly and respectively from two other opposite ends of said top plate, each of said wing plates having a tongue plate projecting inwardly from a respective one of said wing plates, said tongue plate having a resilient bent portion, and an abutment portion formed on said bent portion to abut against said second face.

2. The rotary DIP switch of claim 1, wherein said rotary member further includes a circular projection projecting upwardly from said radial top face into said through hole in said top cover, and a recess that is formed in said circular projection and that is exposed on said top cover.

3. The rotary DIP switch of claim 2, wherein said second face extends inclinedly and inwardly from said one of said first face at an angle of 15° to 70°.

4. The rotary DIP switch of claim 1, wherein said second face extends inclinedly and inwardly from said first face at an angle of 45°.

5. The rotary DIP switch of claim 1, wherein said first face extends upwardly from said radial bottom face and axially of said shaft, and said second face extends inclinedly, inwardly, and upwardly from said first face to said radial top face.

6. The rotary DIP switch of claim 5, wherein said periphery of said rotary member further has a plurality of angularly spaced-apart grooves provided in said second face to releasably receive said abutment portion of said tongue plate.

7. The rotary DIP switch of claim 6, wherein each of said grooves is V-shaped, said top cover being made of a thin metal plate, said abutment portion of said tongue plate being V-shaped and being extendable into a corresponding one of said V-shaped grooves.

8. The rotary DIP switch of claim 1, wherein said first face extends downwardly from said radial top face and axially of said shaft, and said second face extends inclinedly, inwardly, and downwardly from said first face to said radial bottom face.

9. The rotary DIP switch of claim 8, wherein said periphery of said rotary member further has a plurality of angularly spaced-apart grooves provided in said second face to releasably receive said abutment portion of said tongue plate.

* * * * *